US005868512A

United States Patent [19]

Fukushima

[11] Patent Number: 5,868,512

[45] Date of Patent: Feb. 9, 1999

[54] WRITING INSTRUMENT WITH CHECK VALVE MEANS

[75] Inventor: Makoto Fukushima, Kawagoe, Japan

[73] Assignee: Kotobuki & Co., Ltd., Kyoto-Hu, Japan

[21] Appl. No.: 855,495

[22] Filed: May 13, 1997

[30] Foreign Application Priority Data

May 13, 1996 [JP] Japan ..... 8-117270

[51] Int. Cl.[6] ..... B43K 7/10; B43K 7/00

[52] U.S. Cl. ..... 401/219; 401/209

[58] Field of Search ..... 401/219, 209, 401/205; 137/329.03

[56] References Cited

U.S. PATENT DOCUMENTS

| | | | |
|---|---|---|---|
| 5,348,411 | 9/1994 | Ozu et al. | 401/219 |
| 5,655,847 | 8/1997 | Kobayashi et al. | 401/219 |
| 5,709,493 | 1/1998 | Kobayashi et al. | 401/219 |

FOREIGN PATENT DOCUMENTS

| | | | |
|---|---|---|---|
| 971021 | 1/1951 | France | 401/205 |
| 6171290 | 6/1994 | Japan | 401/219 |

*Primary Examiner*—Steven A. Bratlie
*Attorney, Agent, or Firm*—Whitham, Curtis & Whitham

[57] ABSTRACT

A writing instrument comprising a writing ink reservoir containing writing ink therein, a writing ink-passageway communicating with the writing ink reservoir, a writing tip communicating with the ink-passageway, and a check valve mechanism for preventing back-flow of writing ink, the check valve mechanism comprising a valve room provided at a portion of the writing ink-passageway, the valve room having a first area adjacent the writing tip, and a second narrow area adjacent the writing ink reservoir, valve ball movably received within the valve room, and an annular projection provided at the second area of the valve room, the annular projection inclined relative to an axial line of the writing ink-passageway, wherein when the valve ball is located at the second area of the valve room, the second area of the valve room is sealed by the valve ball, thereby preventing writing ink from flowing back toward the writing ink reservoir.

20 Claims, 2 Drawing Sheets

WRITING INSTRUMENT WITH CHECK VALVE MEANS

BACKGROUND OF THE INVENTION

1. Field of the Invention

This invention relates to an improvement of a writing instrument provided with check valve means for preventing back-flow of writing ink.

2. Description of the Prior Art

This type of writing instrument is disclosed in Japanese utility model application No 4752/1993 which was laid-open under Provisionary Publication No 64956/1994 on Sep. 13, 1994.

The conventional writing instrument includes an elongated barrel having an ink-passageway formed therein, a valve room provided at a portion of the ink-passageway, a valve ball received within the valve room, and a writing tip communicating with the ink-passageway. The valve room is formed into a polygonal shape in cross-section which allows a surface of the valve room to substantially come into contact with the valve ball. A plurality of spaced apart projections for restricting movement of the valve ball in a direction toward the writing tip are provided around a portion of the polygonal valve room which is adjacent a tip end of the barrel. Each of the projections projects inwardly from corresponding one of sides of the portion of the polygonal valve room and has a tip end parallel to the corresponding side of the portion of the polygonal valve room.

In the conventional writing instrument, when a user causes the writing tip of the writing instrument to face downwardly in order to write utilizing the writing instrument, the valve ball falls toward the projections while coming into contact with sides of the valve room, and is stopped against the projections. At this time, ink from an ink reservoir housed within the barrel passes through clearances between regions of the valve ball and regions of the valve room which do not come into contact with each other, and is supplied to the writing tip. However, with the conventional writing instrument, each of such clearances is very small, so that feeding of ink to the writing tip can not be smoothly performed and it is therefore impossible to sufficiently feed ink to the writing tip.

SUMMARY OF THE INVENTION

The present invention has been made with a view to overcoming the foregoing problem of the prior art writing instrument.

It is therefore an object of this invention to provide a writing instrument wherein feeding of writing ink to a writing tip can be smoothly performed.

It is another object of this invention to provide a writing instrument wherein it is possible to sufficiently feed writing ink to a writing tip.

In accordance with this invention, there is provided a writing instrument with check valve means. The writing instrument comprises a writing ink reservoir containing writing ink therein; a writing ink-passageway communicating the writing ink reservoir; a writing tip communicating with the ink-passageway; and check valve means for preventing back-flow of writing ink; the check valve means comprising a valve room provided at a portion of the writing ink-passageway, the valve room having a first area adjacent the writing tip, and a second narrow area adjacent the writing ink reservoir, a valve ball movably received within the valve room, and an annular projection provided at the second area of the valve room, the annular projection inclined relative to an axial line of the writing ink-passageway, wherein when the valve ball is located at the second area of the valve room, the second area of the valve room is sealed by the valve ball, thereby preventing writing ink from flowing back toward the writing ink reservoir.

The writing instrument may include adapter means having first and second ends. The adapter means is connected at the first end thereof to the writing tip and connected at the second end thereof to the writing ink reservoir. The writing ink-passageway is formed in the adapter means and communicating with the writing tip and the writing ink reservoir.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which like reference numerals designate the same parts throughout the Figures and wherein.

DETAILED DESCRIPTION OF THE PREFERRED EMBODIMENT

Figure 1:
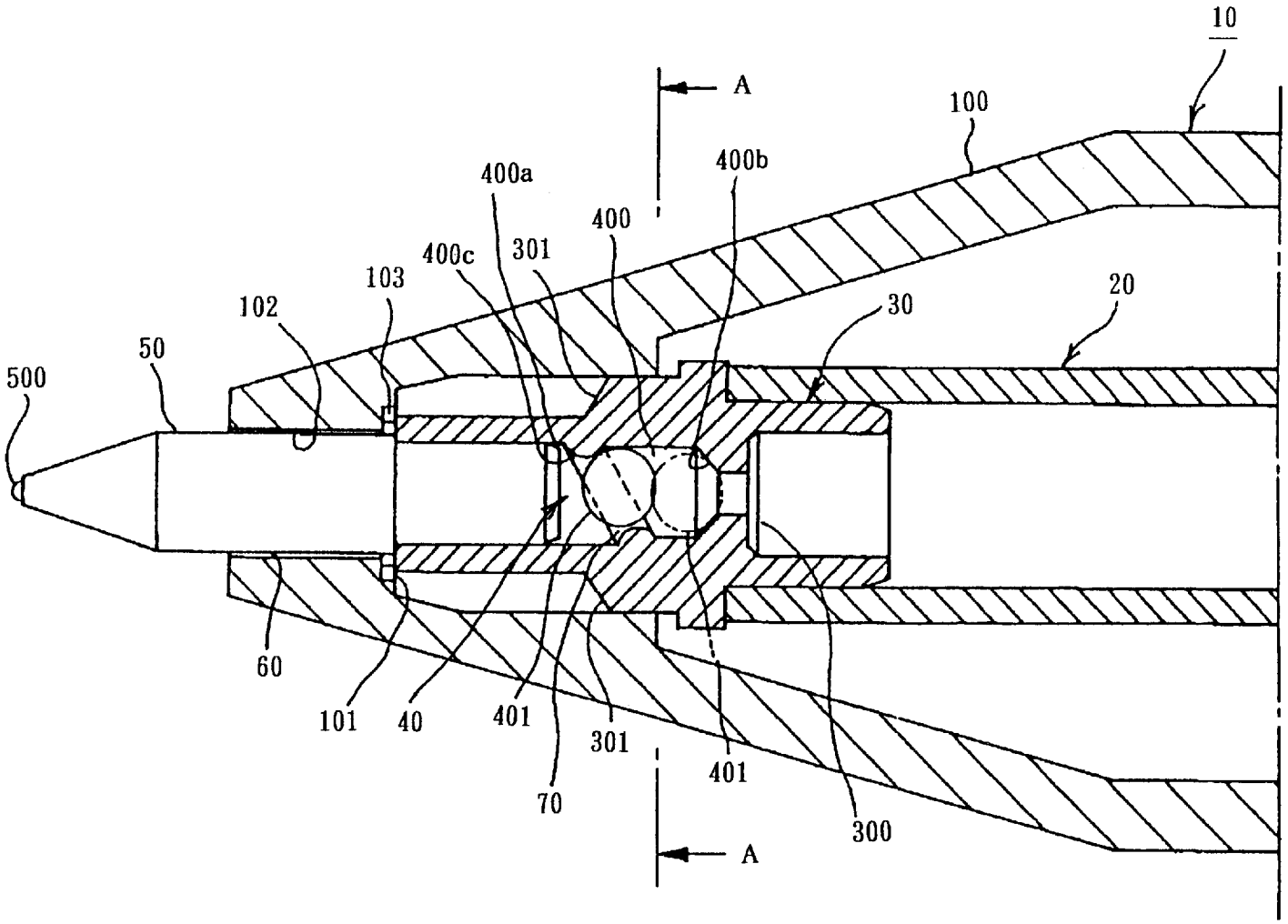
FIG. 1 is a schematic longitudinal sectional view of an essential portion of a writing instrument according to an embodiment of the present invention.
Figure 2:
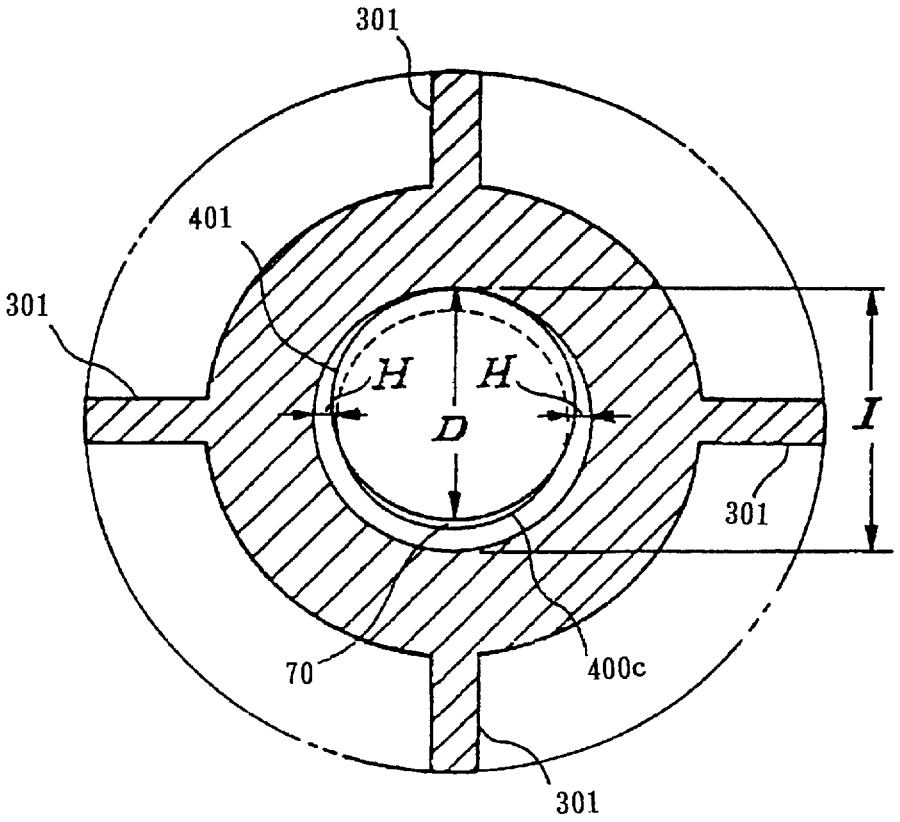
FIG. 2 is a schematic sectional view of the essential portion of the writing instrument of FIG. 1, taken on a plane indicated in FIG. 1 by a line A—A, in which a barrel is removed for clarity of illustration.

Referring to FIGS. 1 and 2, there is illustrated an essential portion of a ball-point pen according to an embodiment of the present invention. The ball-point pen generally includes an elongated barrel 10, a writing ink reservoir 20 of a substantially cylindrical shape containing writing ink therein and housed within the elongated barrel 10, an adapter 30 of a generally cylindrical form press-fitted at a rear end portion thereof in a tip end portion of the ink reservoir 20 and defining a writing ink-passageway 300 communicating with the interior of the ink reservoir 20, check valve means 40 provided at the ink passageway 300 of the adapter 30, and a writing tip 50 press-fitted in a tip end portion of the adapter 30 and communicating with the ink-passageway 300 of the adapter 30, the writing tip 50 having a ball 500 mounted therein. Incidentally, a rear end (not shown) of the elongated barrel 10 is closed. The ink reservoir 20 has any suitable grease (not shown) plugged in a rear end portion thereof for preventing ink from flowing out of the reservoir 20.

The elongated barrel 10 has a head section 100 of a substantially cone-shape in outline on an inner surface of which a circumferential step portion 101 is provided. The head section 100 of the elongated barrel 10 has an opening 102 at a forward end portion thereof The adapter 30 having the writing tip 50 press-fitted in the tip end thereof is abutted at the tip end thereof against the circumferential step portion 101 of the head section 100 with the writing tip 50 penetrating the opening 102 of the head section 100. A diameter of the opening 102 of the head section 100 is larger than an outer diameter of the writing tip 50, so that there is provided a clearance 60 between the writing tip 50 and a circumferential wall portion of the opening 102 of the head section 100. The circumferential step portion 101 of the head section 100 has a plurality of ventilating holes 103 communicating between the clearance 60 and the interior of the head section 100. The adapter 30 has a plurality of ribs 301 provided around an outer periphery thereof and spaced apart from each other. Each of the ribs 301 projects radially from the substantially cylindrical body of the adapter 30 and is in close contact with the inner surface of the head section 100. Air which flows into the clearance 60 from the exterior of the barrel 10 passes through the ventilating holes 103 of the circumferential step portion 101 of the head section 100, passes through spacings among the spaced apart ribs 301 of the adapter 30 and flows in a rearward direction of the barrel 10.

The check valve means 40 includes a valve room 400 provided at a substantially middle portion of the ink-passageway 300, and a valve ball 401 movably received within the valve room 400. The valve room 400 has a first area 400*a* at a portion of the valve room 400 which is adjacent the writing tip 50, and a second area 400*b* at a portion of the valve room 400 which is adjacent the ink reservoir 20. The first area 400*a* has an inner diameter larger than a diameter of the valve ball 401. The second area 400*b* of the valve room 400 is funnel-shaped (tapered) to define a portion of the ink-passageway 300 gradually decreasing in area toward the ink reservoir 20. The tapered area 400*b* of the valve room 400 has a diameter smaller than that of the valve ball 401 but allowing the valve ball to come into contact with the entire surface of the tapered area 400*b* of the valve room 400. The valve room 400 further has an annular projection 400*c* provided at an area of the first portion 400*a* of the valve room 400 which is most adjacent the writing tip 50. The annular projection 400*c* projects inwardly of the valve room 400 and is inclined relative to an axial line of the ink-passageway 300. The annular projection 400*c* may be formed into a generally elliptical shape. In the illustrated example, a dimensional relationship among an inner diameter I of the first area 400*a* of the valve room 400, a height H of the annular projection 400*c*, and a diameter D of the valve ball 401 is as follows: I−2H<D. More particularly, a value which is obtained by doubling a value of the height H of the annular projection 400*c* and subtracting the doubled value from a value of the diameter I of the first area 400*a* of the valve room 400 is previously set in a manner to be smaller than the diameter D of the valve ball 401. The valve ball is adapted to be movable between the second area 400*b* of the valve room 400 and the annular projection 400*c* of the valve ball 401.

In the ball-point pen constructed as described above, when the writing tip 50 of the ball-point pen is directed upwardly by a user, the valve ball 401 within the valve room 400 falls toward the tapered area 400*b* of the valve room 400 and is stopped against the tapered area 400*b* of the valve room 400 as shown by a chain line in FIG. 1. At this time, the valve ball 401 comes into contact with the entire surface of the tapered area 400*b* of the valve room 400 and causes a portion of the ink-passageway 300 to be sealed, so that ink supplied into the valve room 400 from the ink reservoir 20 can be positively prevented from flowing back into the ink reservoir 20.

When the user causes the writing tip 50 of the ball-point pen to be directed downwardly in order to write utilizing the pen, the valve ball 401 falls toward the annular projection 400*c* by gravity and is stopped against any portion of the inclined annular projection 400*c*. Since the dimensional relationship among the inner diameter I of the first area 400*a* of the valve room 400, the height H of the annular projection 400*c*, and the diameter D of the valve ball 401 is embodied by the Equation: I−2H<D, further movement of the valve ball 401 is limited by the annular projection 400*c*. Therefore, the valve ball 401 is prevented from dropping out of the valve room 400. When the valve ball 401 is stopped against the annular projection 400*c*, a large clearance 70 is produced between the valve ball 401 and a portion of the inclined annular projection 400*c* which is adjacent the ink reservoir 20. More particularly, the annular projection 400*c* is inclined relative to the axial line of the ink-passageway 300 as described above, so that when the valve ball 401 is abutted against the inclined annular projection 400*c*, the valve ball 401 deviates from a center axial line of the ink-passageway 300 and is offset toward a portion of the inclined annular projection 400*c* which is adjacent the writing tip 50. Thus, the clearance 70 is produced between the valve ball 401 and the portion of the inclined annular portion 400*c* which is adjacent the ink reservoir 20. In this condition, ink from the ink reservoir 20 can smoothly pass through the clearance 70 and is sufficiently supplied to the writing tip 50.

Incidentally, it is not necessary to form the annular projection 400*c* in such a manner that the height of the entire annular projection 400*c* reaches uniformity. However, at least portion of the annular projection 400*c* should satisfy the above Equation: 1−2H<D.

The term and expressions which have been employed are used as terms of description and not of limitation, and there is no intention in the use of such terms and expression of excluding any equivalents of the features shown and described, or portions thereof, but it is recognized that various modifications are possible within the scope of the invention claimed.

What is claimed is:

1. A writing instrument comprising:

a writing ink reservoir containing writing ink therein;

a writing ink-passageway communicating with said ink reservoir;

a writing tip communicating with said ink-passageway; and check valve means for preventing back-flow of writing ink, said check valve means comprising:

a valve room provided at a portion of said writing ink-passageway, said valve room having a first area adjacent said writing tip and a second area adjacent said writing ink reservoir;

a valve ball movably received within said valve room; and an inclined annular projection provided at said first area of said valve room, said inclined annular projection projecting inward towards an axial line of said writing ink-passageway proximate to said first area of said valve room and inclined at an angle other than 90 degrees relative to said axial line of said writing ink-passageway, wherein when said valve ball is located at said first area of said valve room, said valve ball contacts said inclined annular projection and deviates from a center of the axial line of said writing ink-passage to form a clearance between the valve ball and a portion of the inclined annular projection, thereby allowing writing ink to smoothly flow from said writing ink reservoir to said writing tip.

2. The writing instrument of claim 1, further comprising adapter means having first and second ends, said adapter means being connected at said first end to said writing tip and at said second end to said writing ink reservoir, said writing ink passageway formed in the adapter means.

3. The writing instrument of claim 2, wherein said adapter means is a substantially cylindrical shape.

4. The writing instrument of claim 2, wherein said adapter means includes a plurality of ribs provided around an outer periphery of said adapter means, said ribs are spaced apart from one another.

5. The writing instrument of claim 4, wherein the plurality of ribs project radially from said adapter means and are in substantially close contact with an inner surface of a head section of the writing instrument.

6. The writing instrument of claim 1, wherein said valve ball is offset toward a portion of said inclined annular projection adjacent said writing tip.

7. The writing instrument of claim 1, further comprising a head section having an opening, said writing tip being fitted to said head section, an inner diameter of said opening being larger than an outer diameter of said writing tip, thereby forming a space between said inner diameter of said opening and said outer diameter of said writing tip.

8. The writing instrument of claim 7, wherein:

said head section includes a circumferential step portion, and said head section further includes a plurality of ventilating holes communicating between said space and said head section adjacent said circumferential step portion.

9. The writing instrument of claim 1, wherein:

said first area has an inner diameter larger than a diameter of said valve ball, and said second area is at least partially funnel-shaped so that a portion of said writing ink-passageway gradually decreases in area toward said ink reservoir, and a diameter of said funnel-shaped area is smaller than a diameter of said valve ball so that when said valve ball is in said second area, said valve ball comes into contact with a surface of said funnel-shaped area thus preventing writing ink from flowing back toward said writing ink reservoir.

10. The writing instrument of claim 1, wherein a diameter of said valve ball is less than an inner diameter of said first area minus twice a height of said annular projection.

11. The writing instrument of claim 1, wherein said valve ball is freely movable between said first area and said second area.

12. A writing instrument, comprising:

a writing ink reservoir;

an ink passage communicating with said writing ink reservoir;

a writing tip communicating with said ink passage;

a valve room positioned substantially within said ink passage, said valve room having a first area and a second area, a diameter of said first area being larger than a portion of a diameter of said second area;

a valve ball movable between said first area and said second area, a diameter of said valve ball being larger than the portion of the diameter of said second area;

an inclined projecting annular ring positioned substantially within said first area, said inclined projecting annular ring positioned at an angle other than 90 degrees with respect to an axial centerline of said valve room thereby preventing said valve ball from exiting said first area while providing a clearance so that ink can smoothly pass from said writing ink reservoir to said writing tip when said valve ball is in said first area.

13. The writing instrument of claim 12, wherein said valve ball is offset toward a portion of said inclined projecting annular ring adjacent said writing tip.

14. The writing instrument of claim 12, further comprising an adapter fitted about said writing tip and further fitted about said writing ink reservoir, said adapter further comprising projecting ribs projecting radially from said adapter and in substantially close contact with an inner surface of a head section of the writing instrument.

15. The writing instrument of claim 14, further comprising a body section housing said adapter, said body section further having an opening housing said writing tip, a diameter of said opening being larger than an outer diameter of said writing tip, thereby forming a space between said diameter of said opening and said outer diameter of said writing tip.

16. The writing instrument of claim 12, wherein said second area has a tapered cross section, and when said valve ball is in said second area, said valve ball comes into contact with said tapered area, thereby preventing writing ink from flowing back toward said writing ink reservoir.

17. The writing instrument of claim 12, wherein a diameter of said valve ball is less than an inner diameter of said first area minus twice a height of said inclined projecting annular ring.

18. A writing instrument, comprising:

reservoir means for storing writing ink;

writing means for writing with said ink;

ink passage means for transporting ink from said reservoir means to said writing means;

ink flow regulating means for regulating ink flow between said reservoir means and said writing means, said ink flow regulating means comprising:

a first area and a second area, said first area being proximate to said writing means and said second area being proximate to said reservoir means;

valve means for regulating ink within said ink flow regulating means; and inclined annular means positioned proximate to said first area for preventing said valve means from exiting said ink flow regulating means and for further providing a clearance between said ink flow regulating means and said valve means so that ink can freely flow from said reservoir means to said writing means when said valve means is proximate to said first area, wherein said inclined annular means is positioned at an angle other than 90 degrees relative to an axial centerline of said ink flow regulating means.

19. The writing instrument of claim 18, wherein said ink flow regulating means is substantially circular in shape.

20. The writing instrument of claim 18, wherein said valve means is slidably movable within said ink flow regulating means.

* * * * *